US012305506B1

(12) United States Patent
Cook et al.

(10) Patent No.: US 12,305,506 B1
(45) Date of Patent: May 20, 2025

(54) SYSTEM, METHOD AND APPARATUS FOR ESTIMATING FORMATION STRENGTH

(71) Applicant: Schlumberger Technology Corporation, Sugar Land, TX (US)

(72) Inventors: Harry James Cook, Cambridge (GB); Kjell Haugvaldstad, Vanvikan (NO); Jonathan Dunlop, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/642,151

(22) Filed: Apr. 22, 2024

(51) Int. Cl.

| | |
|---|---|
| ***E21B 49/00*** | (2006.01) |
| ***E21B 10/42*** | (2006.01) |
| ***E21B 47/013*** | (2012.01) |
| ***E21B 47/026*** | (2006.01) |
| ***E21B 47/26*** | (2012.01) |

(52) U.S. Cl.
CPC ..... *E21B 49/005* (2013.01); *E21B 47/013* (2020.05); *E21B 47/026* (2013.01); *E21B 47/26* (2020.05); *E21B 49/006* (2013.01); *E21B 10/42* (2013.01)

(58) Field of Classification Search
CPC ..... E21B 47/013; E21B 47/04; E21B 49/005; E21B 49/006
See application file for complete search history.

(56) References Cited

U.S. PATENT DOCUMENTS

| | | | | |
|---|---|---|---|---|
| 5,720,355 | A * | 2/1998 | Lamine | E21B 17/003 175/45 |
| 7,946,357 | B2 * | 5/2011 | Trinh | E21B 47/013 175/50 |
| 9,145,741 | B2 * | 9/2015 | Trinh | E21B 10/567 |
| 9,938,814 | B2 * | 4/2018 | Hay | E21B 47/12 |
| 9,945,181 | B2 * | 4/2018 | Pelletier | E21B 49/005 |
| 10,012,070 | B2 * | 7/2018 | Pelletier | E21B 47/092 |
| 10,174,563 | B2 * | 1/2019 | Thomas | E21B 10/42 |
| 10,233,698 | B2 * | 3/2019 | Humphrey | E21B 47/07 |
| 10,337,250 | B2 * | 7/2019 | Turner | E21B 47/013 |
| 11,111,732 | B2 * | 9/2021 | Zhan | E21B 10/46 |
| 11,180,989 | B2 * | 11/2021 | Cao | C22C 26/00 |
| 11,692,402 | B2 * | 7/2023 | Clark | E21B 10/325 175/263 |

(Continued)

*Primary Examiner* — Jennifer H Gay

(57) ABSTRACT

Methods and systems are provided that calculate data representing an estimate of formation strength while drilling. The methods and systems employ a drill bit that is instrumented with a first sensor and a second sensor. A processor is configured to i) determine and store first data representing cutting forces acting on a cutting element of the drill bit while drilling based on measurements of the first sensor while drilling, ii) determine and store second data representing depth of cut of the drill bit while drilling based on measurements of the second sensor while drilling, and iii) process the first data and second data to generate and store data representing contact stress against the formation while drilling. This resultant data can be used as an estimate of formation strength. This estimate of formation strength is similar to UCS and can be used in oilfield operations/planning, such as formation characterization while drilling, or drilling efficiency analysis while drilling.

18 Claims, 13 Drawing Sheets

(56) References Cited

U.S. PATENT DOCUMENTS

| | | | | |
|---|---|---|---|---|
| 11,788,362 | B2 * | 10/2023 | Clark | E21B 12/04 175/327 |
| 11,828,164 | B2 * | 11/2023 | Hird | E21B 10/32 |
| 11,905,828 | B1 * | 2/2024 | Chen | E21B 49/003 |
| 12,044,118 | B2 * | 7/2024 | Ghosh | E21B 10/46 |
| 12,123,261 | B1 * | 10/2024 | Clark | E21B 10/567 |
| 2010/0038136 | A1 * | 2/2010 | Trinh | E21B 47/013 175/40 |
| 2012/0312599 | A1 * | 12/2012 | Trinh | E21B 47/00 175/428 |
| 2015/0152723 | A1 * | 6/2015 | Hay | E21B 12/00 175/17 |
| 2015/0218934 | A1 * | 8/2015 | Turner | E21B 47/02 175/45 |
| 2015/0218935 | A1 * | 8/2015 | Pelletier | E21B 47/092 175/327 |
| 2015/0322720 | A1 * | 11/2015 | Pelletier | E21B 49/005 175/41 |
| 2017/0159370 | A1 * | 6/2017 | Evans | E21B 44/005 |
| 2017/0275951 | A1 * | 9/2017 | Thomas | E21B 10/42 |
| 2018/0163527 | A1 * | 6/2018 | Curry | E21B 44/00 |
| 2020/0011171 | A1 * | 1/2020 | Cao | E21B 10/567 |
| 2021/0032936 | A1 * | 2/2021 | Zhan | E21B 12/02 |
| 2021/0301641 | A1 * | 9/2021 | Dunbar | E21B 44/00 |
| 2022/0178246 | A1 * | 6/2022 | Hird | E21B 10/32 |
| 2023/0003120 | A1 * | 1/2023 | Ghosh | E21B 10/52 |
| 2023/0015853 | A1 * | 1/2023 | Wort | E21B 10/56 |
| 2023/0117681 | A1 * | 4/2023 | Clark | E21B 17/1092 175/263 |
| 2024/0035375 | A1 * | 2/2024 | Chen | E21B 49/003 |
| 2024/0384646 | A1 * | 11/2024 | Haugvaldstad | E21B 47/013 |
| 2024/0384652 | A1 | 11/2024 | Haugvaldstad et al. | |
| 2024/0401466 | A1 * | 12/2024 | Hird | E21B 47/07 |

* cited by examiner

SYSTEM, METHOD AND APPARATUS FOR ESTIMATING FORMATION STRENGTH

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Measurement-While-Drilling (MWD) techniques collect drilling-related data, some of which provide insight into the drilling process and the rocks being drilled. MWD parameters such as Rate of Penetration (ROP), Weight-on-Bit (WOB) and Torque-on-Bit (TOB), are typically used to monitor drilling operations. The MWD parameters can also shed light on the mechanical properties of the subsurface rock. However, results from this type of analysis can be inaccurate as the measurements are not always well calibrated and the empirical correlations observed are not universal.

Uniaxial Compressive Strength (UCS) is a mechanical rock property that is commonly used to assess subterranean formations (rock), particularly in applications that extract subterranean oil, gas, water and other minerals. UCS is defined as "the maximum compressive stress that can be applied to a material, such as a rock, under given conditions, before failure occurs" (AGI). The given conditions include single-axis compression (hence uniaxial) without perpendicular stress on the sample (hence unconstrained). UCS values typically range from less than 5 MPa (very low strength or very weak rocks) to greater than 250 MPa (very high strength or extremely strong rocks), as defined by the International Society for Rock Mechanics (ISRM). Specifically, UCS is often used to determine the extent to which a particular formation can be drilled before it becomes necessary to replace part or all of a drill bit used for this purpose.

Traditionally, UCS is measured using a laboratory test at atmospheric pressure on a rock sample, e.g., core sample. Scratch testing is a popular laboratory test method of measuring UCS of a rock sample. This process is well documented in literature but simply put, involves a cutting element of known geometry being scraped across the rock sample at a given depth of cut, with normal cutting forces ($F_n$) and tangential forces ($F_t$) relative to the direction of cut being recorded. Up to a certain critical depth of cut ($D_c$), which is governed by cutter geometry and rock characteristics, but usually very shallow, UCS has been shown in literature to be proportional to the tangential cutting stress (or tangential force) divided by the engaged contact area between the cutter and formation. The collection and laboratory analysis of the rock sample to measure USC is a time-consuming and expensive process, preventing real-time data analysis and decision making while drilling.

BRIEF SUMMARY

In embodiments, methods and systems are provided that calculate data representing an estimate of formation strength while drilling. The methods and systems employ a drill bit that is instrumented with a first sensor and a second sensor. A processor is configured to i) determine and store first data representing cutting forces acting on a cutting element of the drill bit while drilling based on measurements of the first sensor while drilling, ii) determine and store second data representing depth of cut of the drill bit while drilling based on measurements of the second sensor while drilling, and iii) process the first data and second data to generate and store data representing contact stress against the formation while drilling. This resultant data can be used as an estimate of formation strength. This estimate of formation strength is similar to UCS and can be used in oilfield operations/planning, such as formation characterization while drilling, or drilling efficiency analysis while drilling.

In embodiments, the first sensor can be integral to the cutting element of the drill bit.

In embodiments, the second sensor can be integral to the drill bit at a predefined location offset from the first sensor.

In embodiments, the first sensor can be configured to measure forces acting on the cutting element of the drill bit while drilling.

In embodiments, the second sensor can include a depth sensor that contacts and rides on a bottom hole surface while drilling and is used to measure a gradient or slope of the bottom hole surface while drilling.

In embodiments, measurements of the second sensor while drilling can be mapped to the second data representing depth of cut of the drill bit while drilling, and the second data can be mapped to data representing depth of the cutting element of the drill bit while drilling. Data representing surface area contacted by the cutting element while drilling can be determined from the data representing depth of the cutting element of the drill bit while drilling and data representing geometry of the drill bit. Data representing contact stress against the formation while drilling can be determined from the first data and the data representing surface area contacted by the cutting element while drilling.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

This disclosure generally relates to methods and systems for estimating formation strength while drilling a borehole. For example, a drilling system can include a drill bit that is instrumented with a first sensor and a second sensor. A processor can be configured to i) determine and store first data representing cutting forces acting on a cutting element of the drill bit while drilling based on measurements of the first sensor while drilling, ii) determine and store second data representing depth of cut of the drill bit while drilling based on measurements of the second sensor while drilling, and iii) process the first data and second data to generate and store data representing contact stress against the formation while drilling. This resultant data can be used as an estimate of formation strength. This estimate of formation strength is similar to UCS and can be used in oilfield operations/planning, such as formation characterization while drilling, or drilling efficiency analysis while drilling as described herein.

In embodiments, the first sensor can be integral to the cutting element of the drill bit, and the second sensor can be integral to the drill bit at a predefined location offset from the first sensor.

In embodiments, the first sensor can be configured to measure forces acting on the cutting element of the drill bit while drilling.

In embodiments, the second sensor can include a depth sensor that contacts and rides on a bottom hole surface while drilling and is used to measure a gradient or slope of the bottom hole surface while drilling.

Figure 1:
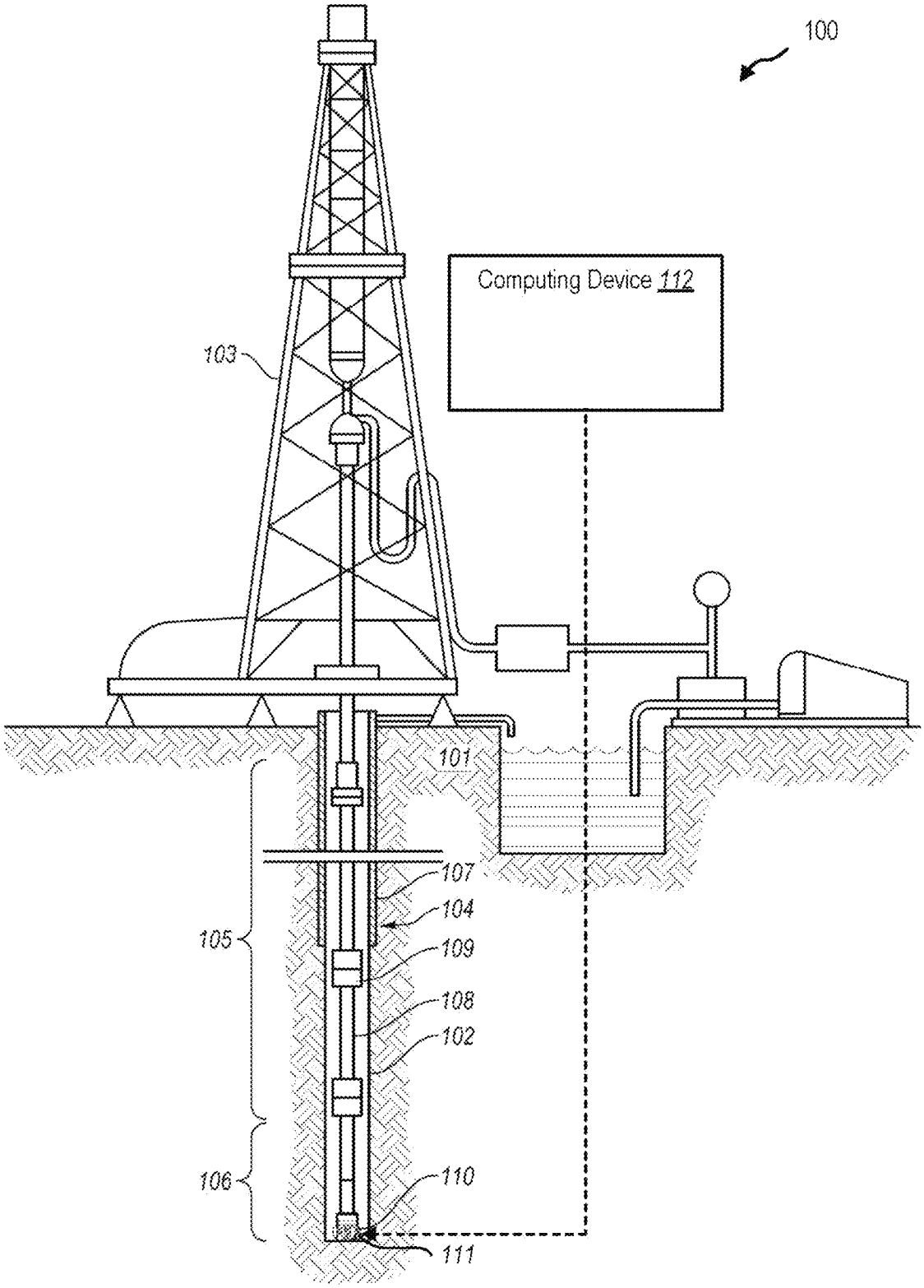
FIG. 1 is a schematic diagram illustrating an embodiment of a drilling system for drilling an earth formation to form a borehole.

FIG. 1 shows one embodiment of a drilling system 100 for drilling an earth formation 101 (e.g., an earth formation) to form a wellbore or borehole 102. The drilling system 100 includes a drill rig 103 used to turn a drilling tool assembly 104 which extends downward into the borehole 102. The drilling tool assembly 104 includes a drill string 105, a bottomhole assembly ("BHA") 106, and a drill bit 110. The drill bit 110 is attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, rotational power is transmitted by one or more mud motors located in the borehole 102. In some embodiments, the drill string 105 further includes additional components such as subs, pup joints, etc. The drill pipe 108 provides a hydraulic passage through which drilling fluid is pumped from the surface. The drilling fluid discharges through selected-size nozzles, jets, or other orifices in the drill bit 110 for the purposes of cooling the drill bit 110 and cutting structures thereon, and for lifting cuttings out of the borehole 102 as it is being drilled.

The BHA 106 may include the drill bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change direction of the drill bit 110, and thereby the trajectory of the borehole 102. At least a portion of the RSS may maintain a geostationary position relative to an absolute reference frame, such as gravity, magnetic north, and/or true north. Using measurements obtained with the geostationary position, the RSS may locate the drill bit 110, change the course of the drill bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit drill bit 110 may be any type of bit suitable for degrading downhole materials. For instance, the drill bit 110 may be a drill bit suitable for drilling the earth formation 101. Example types of drill bits used for drilling earth formations are fixed-cutter or drag bits. In embodiments, the drill bit 111 can include cutting elements that contact the rock formation and cut into the rock formation while the drill bit 111 rotates while drilling. At least one of the cutting elements can be instrumented with a first sensor (e.g., force sensor). The drill bit 111 can also be instrumented with a second sensor (e.g., depth sensor). A processor, e.g. computing device 112, can be configured to i) determine and store first data representing cutting forces acting on a cutting element of the drill bit while drilling based on measurements of the first sensor while drilling, ii) determine and store second data representing depth of cut of the drill bit while drilling based on measurements of the second sensor while drilling, and iii) process the first data and second data to generate and store data representing contact stress against the formation while drilling. This resultant data can be used as an estimate of formation strength. This estimate of formation strength is similar to UCS and can be used in oilfield operations/planning, such as formation characterization while drilling, or drilling efficiency analysis while drilling as described herein.

The computing device 112 may be in data communication with the drill bit sensors and configured to receive one or more signals from the sensor 111. In some embodiments, the computing device 112 is located at the surface and operated while drilling the borehole 102. For example, the computing device 112 may be a drilling computer or any other user equipment at the surface of the borehole 102 (e.g., located at or associated with the drill rig 103). In other embodiments, the computing device 112 can be located in the borehole 102 and operated while drilling the borehole 102. For example, the computing device may be associated with and/or located in a component of the drilling tool assembly such as at the BHA 106 or the bit itself. The computing device 112 may be located in close proximity to the drill bit sensors in the borehole 102 or may be located at another location within the borehole 102. In this way the drill bit sensors may transmit one or more signals to the computing device 112, such as one or more measurements taken in the borehole 102. The computing device 112 may include a processor and memory (e.g., as described below with reference to FIG. 11). The memory may contain one or more instructions which, when executed, cause the processor to perform one or more parts of the methods as described herein.

Figure 2:
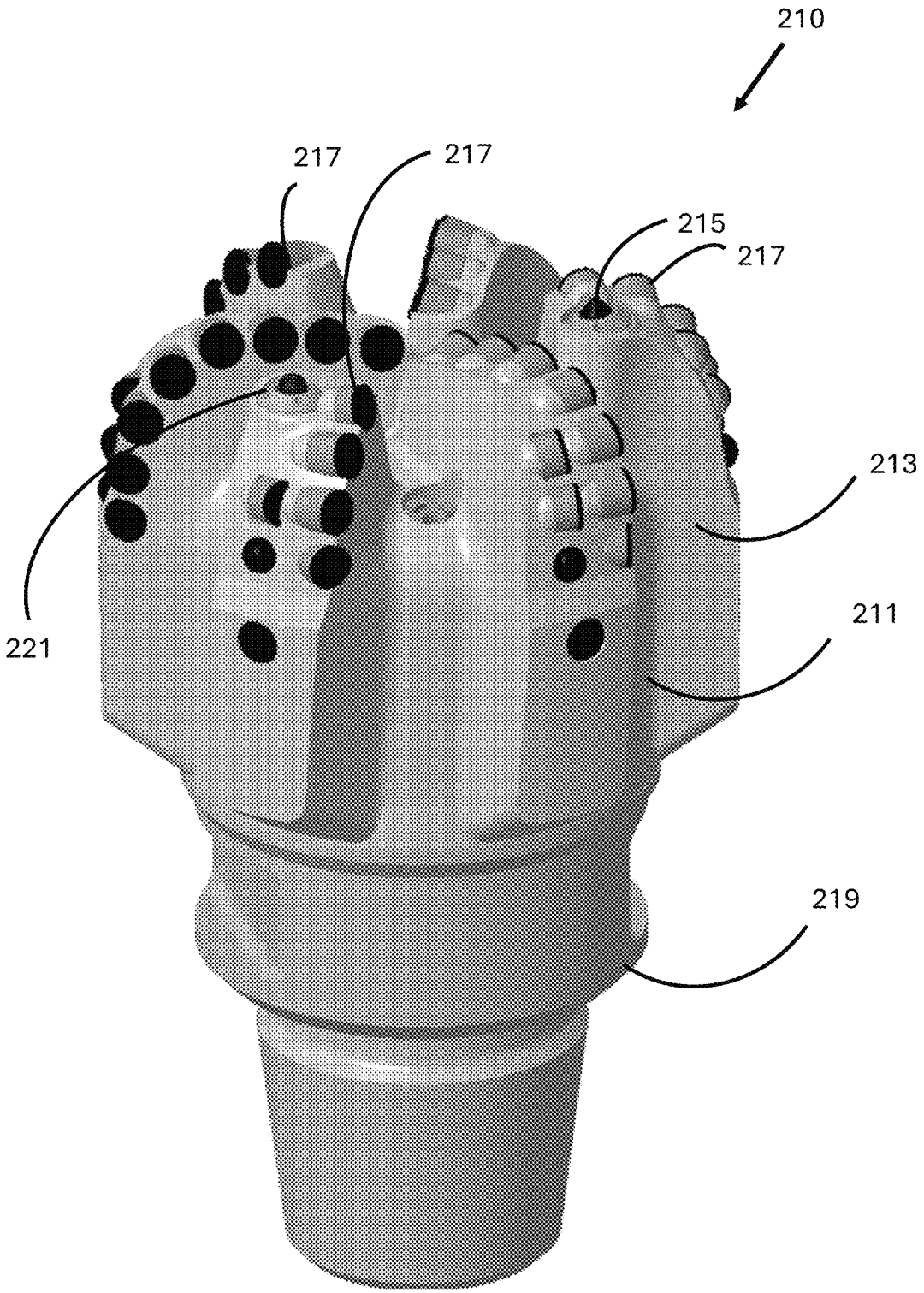
FIG. 2 is a bottom view of a drill bit in accordance with the present disclosure.

FIG. 2 is a bottom view of the downhole end of a drill bit 210 according to at least one embodiment of the present disclosure. The drill bit 210 includes a bit head 211 with a number of blades or projections 213 having conical or other non-planar cutting elements (one shown as 215) as well as planar or gauge cutting elements 217 (e.g., shear cutters). The drill bit 210 further includes a pin 219. In embodiments, the bit head 211 may be secured to the pin 219 with a bolted connection, such as with one or more mechanical fasteners (not shown). The bit 210 may include a bit body 213 from which a plurality of blades may protrude.

In embodiments, at least one cutting element of the drill bit 210, such as conical or non-planar cutting element 215, can be instrumented with a first sensor to determine and store first data representing cutting forces acting on the cutting element while drilling. For example, the instrumented cutting element 215 may contact or engage the borehole as the drill bit 210 rotates, and the instrumented cutting element 215 may experience changing dynamics (e.g., axial forces) as it passes over and/or past physical features of the borehole. These changes may be measured by the first sensor. The measurements of the first sensor can be processed to determine and store the first data representing cutting forces acting on the cutting element over time while drilling. The processing can involve sampling, analog-to-digital conversion, filtering, averaging and possibly other signal processing operations and calculations.

In some embodiments, the first data is based on or associated with one or more forces experienced or exhibited by the instrumented cutting element. For example, the first sensor may measure force, strain, stress, pressure, deformation, deflection, displacement, any other parameter associated with the forces experienced or exhibited by the instrumented cutting element. In some embodiments, the first sensor can measure force, either directly or indirectly through other measurements. In embodiments, the first sensor can be a strain gauge, hall effect sensor, magnet, capacitive sensor, spring sensor, any other sensor for sensing dynamics and/or forces related to an engagement of the cutting element 215 with the borehole, and combinations thereof.

In embodiments, the first sensor may be disposed in a bore formed in the instrumented cutting element 215. In other embodiments, the first sensor may be disposed at another location relative to the cutting element 215. For example, the first sensor may be in contact with the cutting element 215, or located adjacent to the cutting element 215.

In embodiments, the drill bit 210 can also be instrumented with at least one depth sensor 221. The sensor measurements of the depth sensor 221 can be processed to determine and store second data presenting depth of cut of the drill bit 210 over time while drilling. The processing can involve sampling, analog-to-digital conversion, filtering, averaging and possibly other signal processing operations and calculations.

In embodiments, the BHA or the drill bit 210 can include a rotation sensor that measures rotational orientation of the drill bit 210. The sensor measurements of the rotational sensor can be processed to determine and store the rotation data that represents the rotational orientation of the drill bit as a function of time while drilling. The processing can involve sampling, analog-to-digital conversion, filtering, averaging and possibly other signal processing operations and calculations.

The second data may be generated from one or more measurements taken by the depth sensor 221, for example, corresponding to a depth of the downhole tool. The second data may correspond to a depth at which the first data (or other downhole measurements) were taken. For example, the second data may indicate depth of the downhole tool at one or more (or all) instances of the first data. The second data may be acquired based on a timing and/or a duration of one or more downhole operations. In some embodiments, the second data may be associated with the rotation data. For example, the rotation data may identify and/or track each revolution of the downhole tool, and the second data may indicate a depth corresponding to each revolution. In this way, the second data may facilitate mapping or associating a depth associated with one or more portions of the first data (cutting force data).

It should be understood that the cutting element(s) of the BHA is not limited to the configurations and/or orientations illustrated and described herein. For example, an instrumented cutting element may be oriented at an angle from vertical, in a radial or outward direction, or any other orientation for engaging the borehole as described herein. In this way, any type of downhole tool may include an instrument assembly (including an engagement element) having any configuration for taking downhole measurements, and the instrument assembly may be configured, oriented, and adapted to function in accordance with the manner in which a given downhole tool engages the borehole.

Figure 3A:
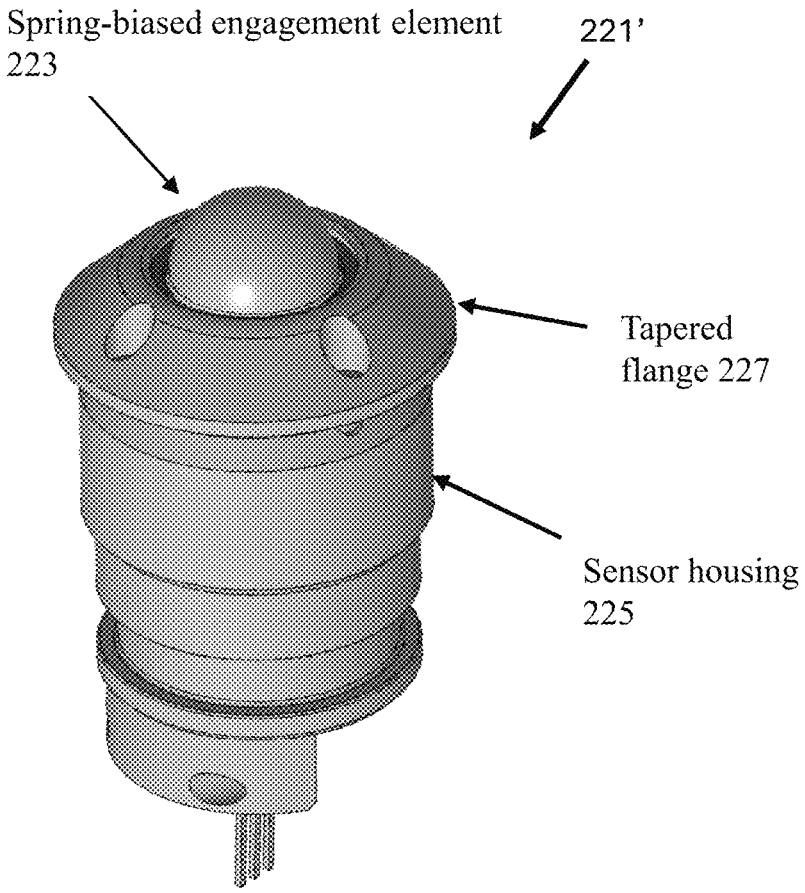
FIG. 3A is a perspective view of a depth sensor that can be integrated into a drill bit in accordance with present disclosure.
Figure 3B:
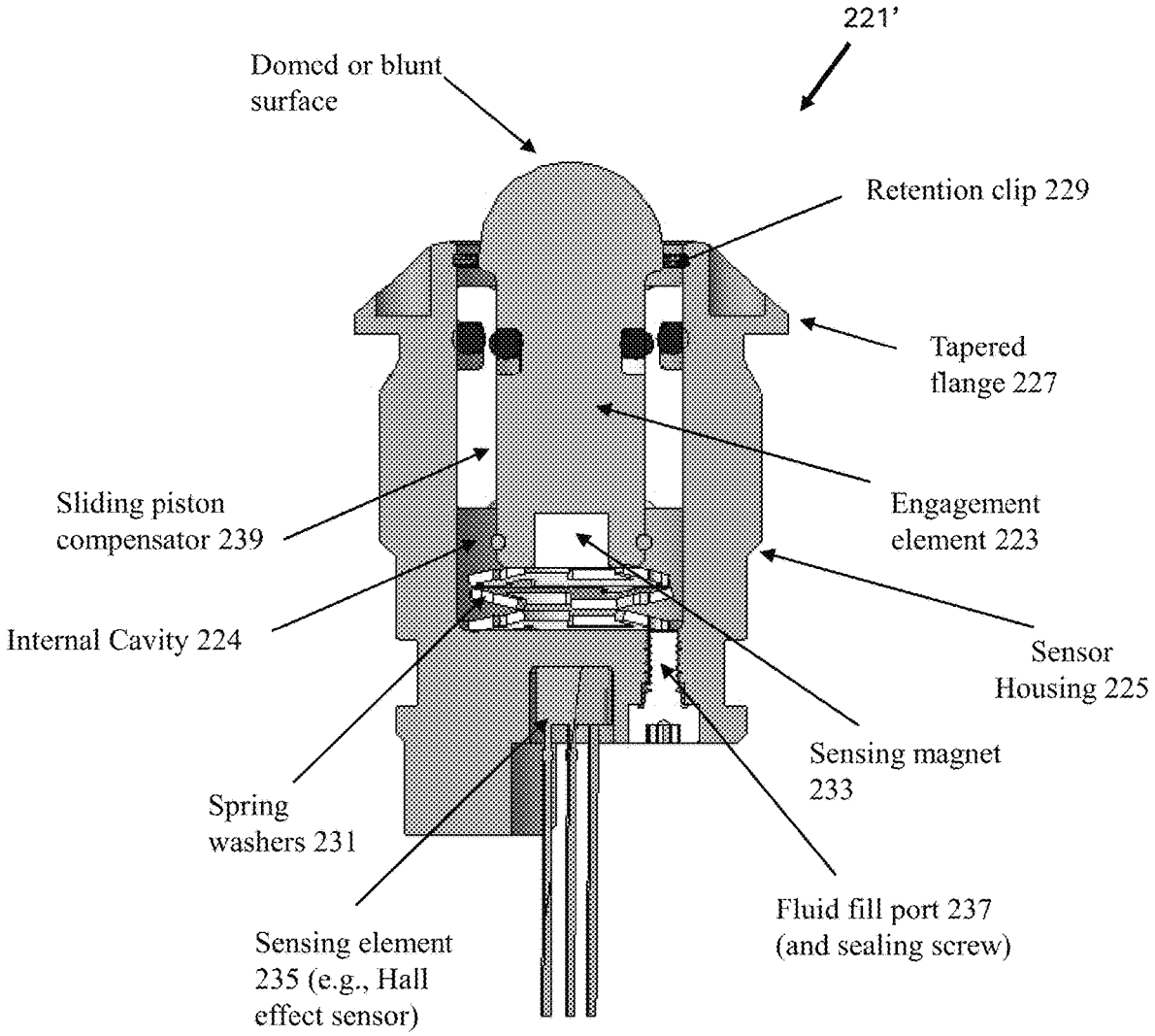
FIG. 3B is a cross-sectional view of the depth sensor of FIG. 3A.

FIGS. 3A and 3B illustrates a depth sensor 221' in accordance with the present disclosure, which includes a spring-biased engagement element 223 retained with an internal cavity 224 formed by a sensor housing 225. The top part of the sensor housing 225 has a tapered flange 227 that overlaps the outer surface of the drill bit. The bottom part of sensor housing 225 is received within a bore that extends into the drill bit (not shown). The top part of the engagement element 223 has a domed or blunt surface that extends beyond the tapered flange 227. The spring-biased engagement element 223 can slide/move linearly within the internal cavity 224 while drilling to permit the domed or blunt surface of the engagement element 223 to ride on the bottom hole surface (without cutting). A retention clip 229 retains the spring-biased engagement element 223 such that the spring-biased engagement element is disposed within and slidable in the internal cavity 224. One or more spring washers 231 are disposed in the internal cavity 224 adjacent to the end of the engagement member 223 opposite the domed or blunt surface. The spring washer(s) 231 provide a resilient spring bias force that biases the engagement element 223 in a fully extended position with the domed surface at a maximum offset relative to the tapered flange 227. When the domed or blunt surface of the engagement element 223 rides on the bottom hole surface during drilling, the engagement element 223 can move inward toward the sensor housing 225 in response to contact forces applied by the bottom hole surface and move outward away from the sensor housing 225 in response to the bias forces applied by the spring washer(s) 231. A sensing magnet 233 is mounted within the internal cavity 224 at or near the end of the engagement element opposite the domed or blunt surface. A stationary sensing element 235 is mounted in a recess outside the internal cavity 224 at a position offset from the variable position of the sensing magnet 233. The sensing element 235 can be configured to sense the relative offset between itself and the sensing magnet 233 to measure the variable axial position of the sensing magnet 233 within the internal cavity 224. In embodiments, the sensing element 235 can be a Hall sensor or other suitable non-contact position sensor. In embodiments, the internal cavity 224 can be filled with fluid that acts as a sliding pressure compensator. In this case, the sensor housing 225 can include a fluid fill port 237 that extends from outside the housing into the internal cavity 224 and is used to fill the internal cavity 224 with fluid. The fill port 237 can receive a sealing screw to close the port 237.

The domed or blunted configuration of the engagement element 223 is important since the engagement element 223 rides on the bottom hole surface (without cutting) to accurately detect a gradient instead of scratching or cutting. A solid polycrystalline diamond part or other material with high abrasion resistance, such as tungsten carbine, can be used to form at least the domed or blunted part of the engagement element 223 since it will be rubbing on the bottom hole surface for long periods of time while drilling.

Furthermore, downhole pressure will tend to push the engagement element 223 into the internal cavity 224 giving an inaccurate displacement reading. Therefore, this needs to be compensated for by balancing pressures applied to the engagement element 223. FIG. 3B shows one method for achieving this pressure balancing, with an annular sliding piston/compensator 239 sealed against the bore that defines the internal cavity 224 and around the engagement element 223. The sealed void behind the sliding piston compensator 239 and the engagement element 223 is then filled with a thin hydraulic fluid from the fill port 237, ensuring all air is removed, and then the port 237 is closed. Now, when bottom hole pressure acts on the surface areas of the annular piston compensator 239 and the engagement element 223, the fluid is squeezed, thus balancing pressures without movement of the engagement element 223. Now, when the additional force acting on the engagement element 223 from formation creates an imbalance, the engagement element 223 is free to slide inward toward the sensor housing 225 and compress the spring washer(s), and the volume change is accommodated by the sliding piston compensator 239.

The displacement of the engagement element 223 within the sensor housing 225 can be measured using several different sensor options, such as Linear Variable Differential Transformer (LVDT), potentiometer, optical, laser or contact. In the configuration shown in FIG. 3B, the displacement of the engagement element 223 within the sensor housing 225 is measured by a hall effect sensor and magnet. The benefits of the hall effect sensor and magnet are that the hall effect sensor can be kept sealed in the electronics housing without the need to expose it to the downhole pressure. FIG. 3B shows by installing the hall effect sensor on the other side of a thin wall section/diaphragm with a magnet at the rear of the engagement element, displacement can be measured without the need to seal around the sensor. Lab testing has shown that excellent measurement sensitivity can be achieved in this configuration.

Figures 4A, 4B:
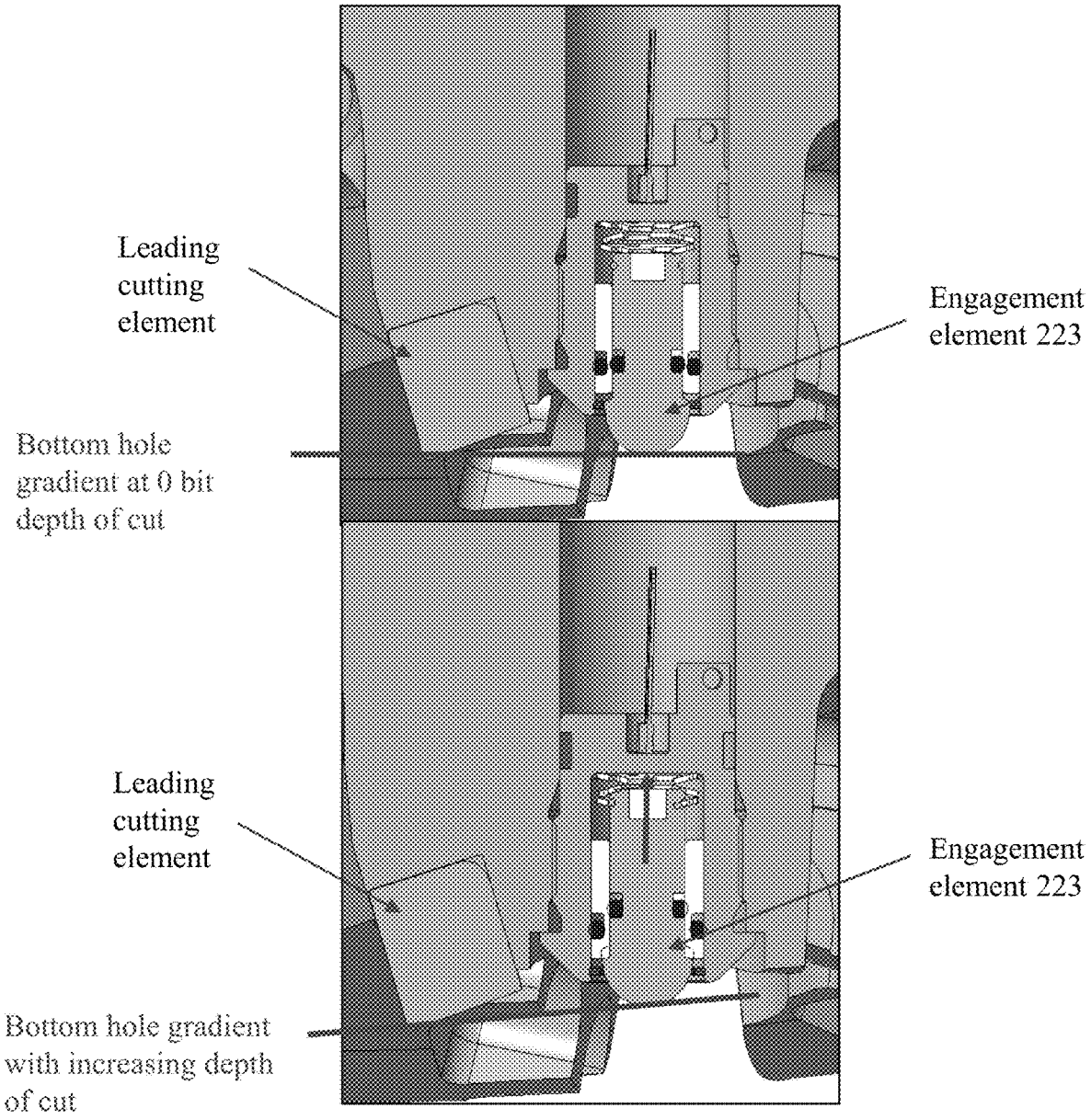
FIGS. 4A and 4B are schematic diagrams illustrating operation of the depth sensor of FIGS. 3A and 3B while drilling.

FIGS. 4A and 4B illustrate the operation of the depth sensor 221' of FIGS. 3A and 3B while drilling and shows the engagement element 223 riding on the bottom hole surface (without cutting) to accurately detect gradients while drilling. The gradient represents the change in height or slope of the bottom hole surface between a leading fixed cutting element and the depth sensor while drilling (e.g., FIG. 7). The gradient can be determined from the displacement of the engagement element 223 as measured by the depth sensor 221 and the geometry of the drill bit, and the gradient can be mapped to depth of cut as described below with respect to FIGS. 5 to 7. Note that the gradient of the bottom hole surface corresponding to zero or null bit depth of cut corresponds to the fully extended position of the engagement element as shown.

Figure 5:
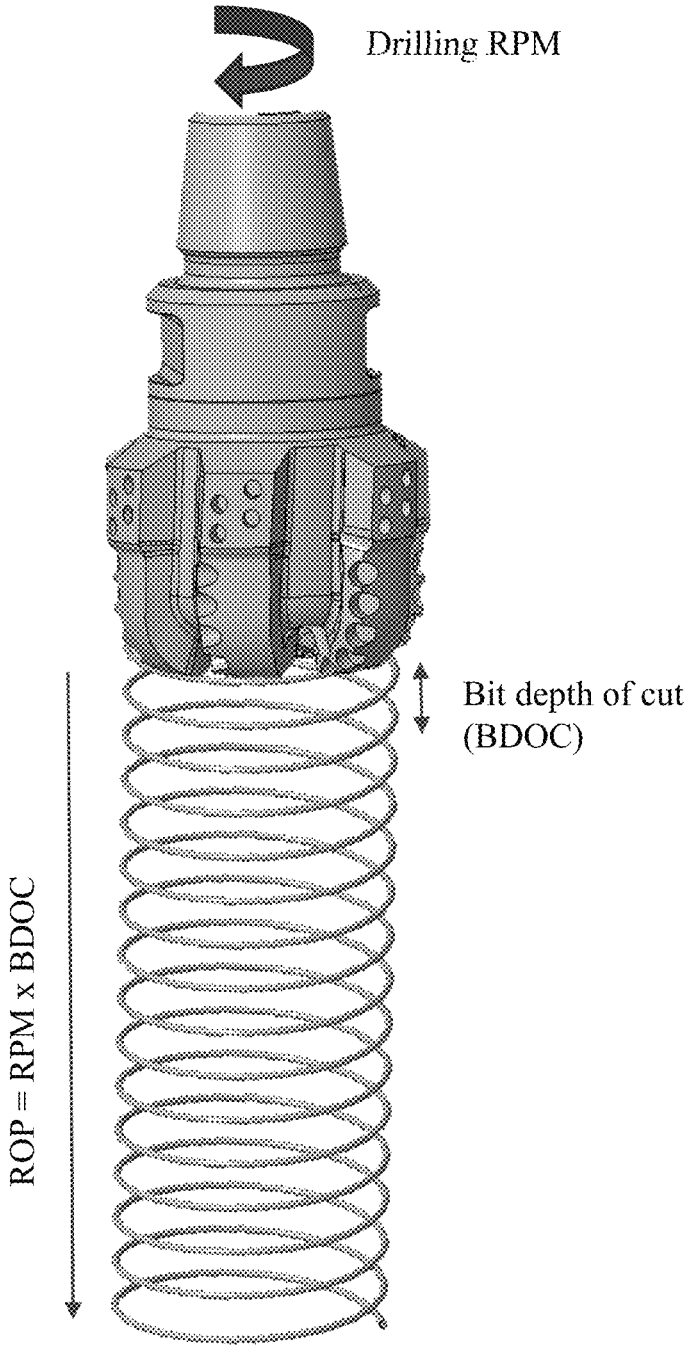
FIG. 5 is a schematic diagram illustrating bit depth of cut (BDOC) while drilling.

FIG. 5 shows the trajectory of a single fixed cutting element on a drill bit plotted in 3D whilst drilling. This creates a helical path as shown. The diameter of the helical path is dictated by the radial position of the fixed cutting element on the bit, and the pitch, by the bit depth of cut in a single revolution (BDOC). Therefore, the rate of penetration along the axis of the helical path is determined by the BDOC multiplied by the number of rotations over a given period, typically rotations per minute (RPM).

Figure 6:
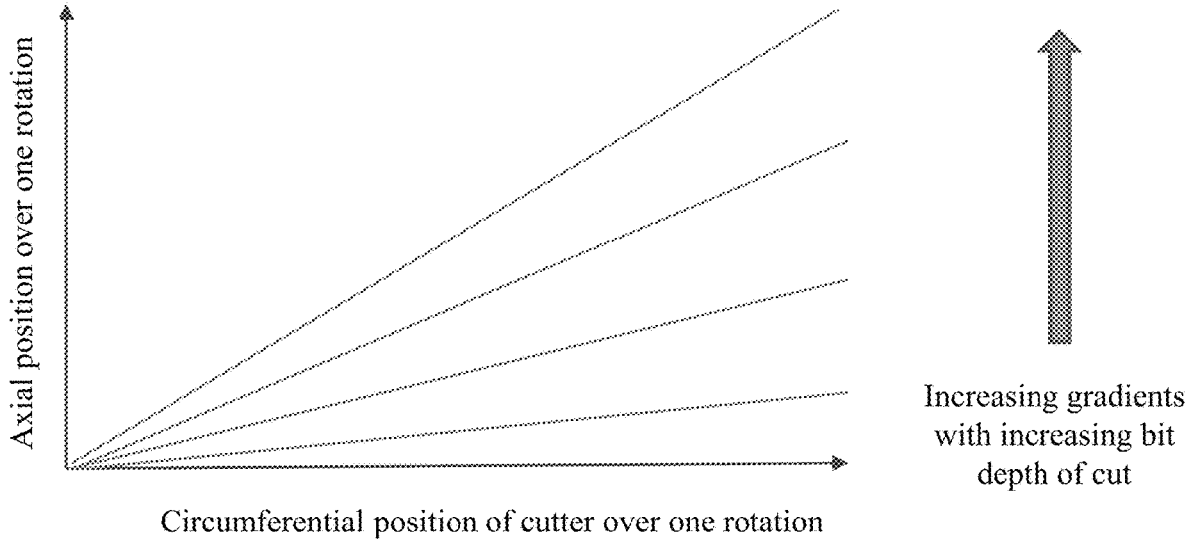
FIG. 6 depicts plots of BDOC over one rotation of the drill bit (y-axis) as a function of circumferential cutter position over one rotation of the drill bit (x-axis) for increasing gradients as calculated from depth sensor measurements while drilling.

If the helical path is unraveled and the position of the cutting element is plotted in 2D with circumferential position on the x axis and axial position on the y axis, then for a single rotation of the bit, the y axis is BDOC as shown in FIG. 6. As BDOC increases, the gradient on which the cutting element is travelling will also increase through each revolution as shown.

Figure 7:
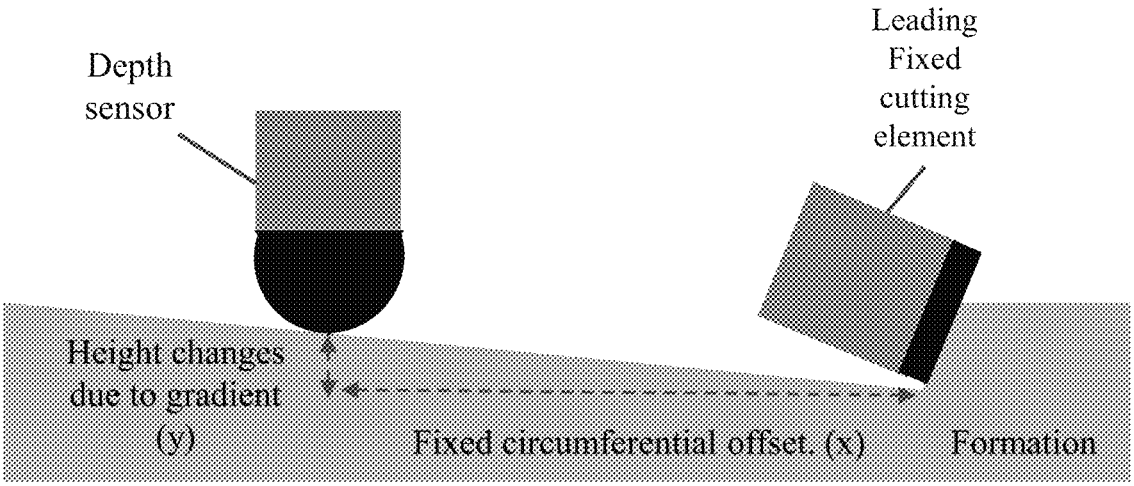
FIG. 7 is a schematic diagram illustrating the gradient or slope of the bottom hole surface between a leading fixed cutting element and the depth sensor while drilling.

As the bit drills, this gradient is cut into the formation under the bit. Therefore, if a second fixed cutting element is introduced at the same radial and axial position as the first cutting element but set back a known distance circumferentially on the bit, then the depth of cut seen by this second cutting element will be dictated by the gradient left by the leading cutting element and the circumferential offset between them. However, if the second fixed cutting element is substituted by a depth sensor as described herein, the depth sensor will rise and fall with the bottom hole surface while drilling. In this configuration, with the displacement of the depth sensor measured and the circumferential distance offset between the leading fixed cutting element and the depth sensor is known, the slope gradient and resulting BDOC can be determined as shown in FIG. 7. This mapping can be stored in a lookup table or other logical data structure or code segment that is accessed to output a value of BDOC of the drill bit corresponding to a gradient value provided as input.

Figure 8:
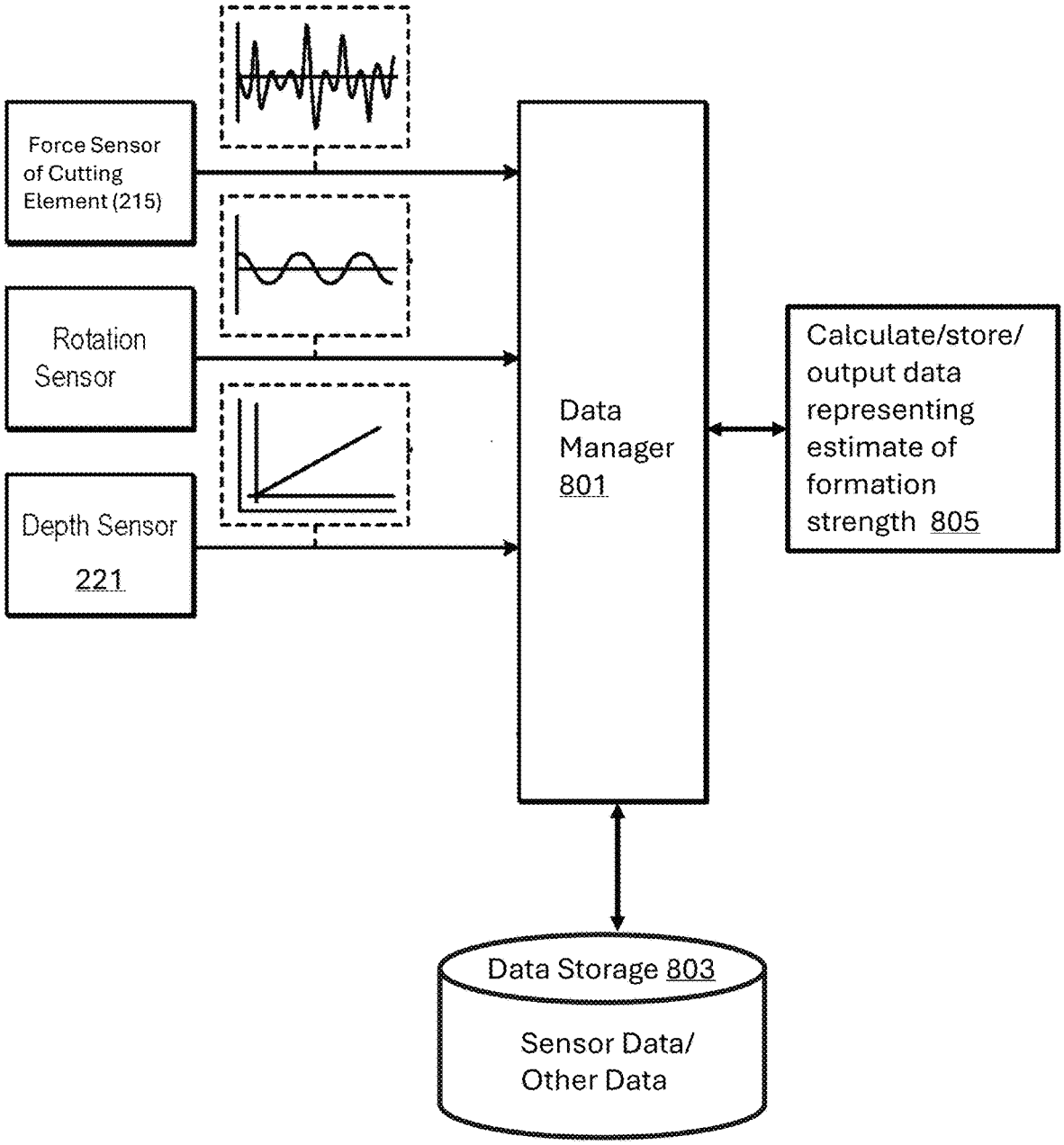
FIG. 8 illustrates an example computing device according to the present disclosure.

FIG. 8 illustrates an example computing device configured to calculate/store/output data representing an estimate of formation strength in accordance with at least one embodiment of the present disclosure. In some embodiments, the system includes a data manager 801 configured to receive sensor signals or data from the first sensor (force sensor), the second sensor (depth sensor) and a rotation sensor as described herein. The sensor signals or data can represent measurements that are taken, for example, in the borehole while drilling. In some embodiments, the data manager 801 receives the sensor signals or data and processes and stores data presenting the sensor measurements in data storage 803 as sensor data. In embodiments, the processing can involve sampling, analog-to-digital conversion, filtering, averaging and possibly other signal processing operations and calculations.

The computing device also includes executable software code 805 configured to access the sensor data stored in the data storage 803 and use the sensor data to calculate/store/output data representing an estimate of formation strength while drilling. Such calculations can employ other data stored in the data storage 803 as needed.

Figure 9:
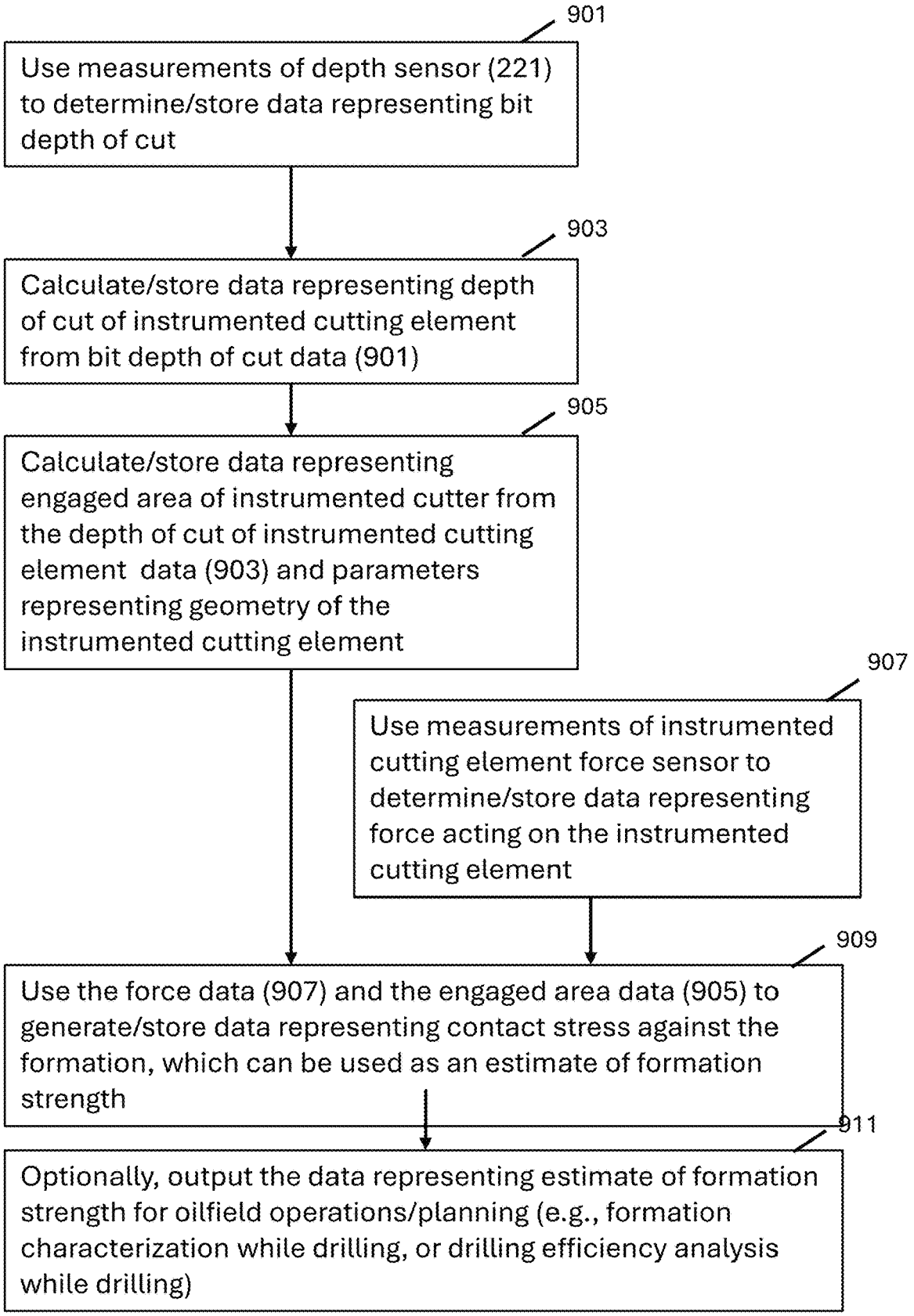
FIG. 9 is a flow chart illustrating a method in accordance with the present disclosure.

FIG. 9 illustrates a flow diagram for a method or process that calculates data representing an estimate of formation strength while drilling according to at least one embodiment of the present disclosure. While FIG. 9 illustrates operations according to one embodiment, alternative embodiments may omit, add to, reorder, or modify any of the operations shown in FIG. 9.

The method begins in block 901 where measurements of depth sensor (221 or 221') can be used to determine and store data representing bit depth of cut (BDOC). For example, the measurements of the depth sensor can be used to determine bit depth of cut (BDOC) whilst drilling. In embodiments, the bit depth of cut (BDOC) can be specified as an amount of penetration (in mm) per rotation or revolution of the drill bit.

In embodiments, the measurements of depth sensor (221 or 221') can be mapped to bit depth-of-cut (BDOC). This mapping can be stored in a lookup table or other logical data structure or code segment that is accessed to output a value of bit depth of cut based on one or more measurements of the depth sensor provided as input.

For example, this mapping can be provided by an equation of the form:

$$BDOC=(2*\pi*r*y)/x \quad \text{(Eqn. 1)}$$

where x is the fixed circumferential offset between the depth sensor and the leading fixed cutting element of the bit relative to the depth sensor (see FIG. 7), y is the height change of the depth sensor due to the gradient of the cut rock, which is measured by the depth sensor (see FIG. 7), and r is the radial position of the depth sensor relative to the center axis of the drill bit.

In other embodiments, other suitable mapping functions can be used. In embodiments, multiple bit depth-of-cut (BDOC) values can be calculated from multiple data-points of the height change y as measured by the depth sensor over time, and these multiple bit depth-of-cut (BDOC) values can be averaged or smoothed to provide the bit depth-of-cut (BDOC) while drilling.

In block 903, data representing depth of cut of the instrumented cutting element (i.e., the cutting element with the first sensor) can be calculated from the bit depth of cut data (901), and such data can be stored. In this block, the bit depth of cut data (901) can be combined with bit design information to calculate and store data representing depth of cut of the instrumented cutting element.

In embodiments, the data representing the bit depth of cut (from 901) can be mapped to the depth of cut of the instrumented cutting element. This mapping can be stored in a lookup table or other logical data structure or code segment that is accessed to output a value of depth of cut of the instrumented cutting element corresponding to a bit depth of cut value provided as input.

For example, the bit depth of cut determined in 901 can be mapped to a depth of cut of the instrumented cutting element (i.e., the cutting element with the first sensor) y' by an equation of the form:

$$y' = \frac{(BDOC * x')}{(2 * \pi * r')} + \text{Tipp_offset} \quad \text{(Eqn. 2)}$$

where x' is the circumferential offset between the instrumented cutting element (i.e., the cutting element with the first sensor) and the leading fixed cutter element disposed adjacent to the depth sensor, r' is the radial position of the instrument cutting element (i.e., the cutting element with the first sensor) relative to the center axis of the drill bit, and Tipp_offset is a bit design parameter of the drill bit and quantifies the exposure of the tip of the instrumented cutting element (i.e., the cutting element with the first sensor) relative to the tip of the leading fixed cutter element disposed adjacent to the depth sensor (with a positive tip offset the instrumented cutting element is sticking out ahead of the leading cutter element while a negative tip offset the instrumented cutting element is retracted below the tip of the leading cutter element).

In other embodiments, other suitable mapping functions can be used.

In block 905, data representing engaged area of instrumented cutting element can be calculated from the depth of cut of instrumented cutting element data (903) and parameters representing geometry of the instrumented cutting element, and such data can be stored. In this block, the circumferential offset between the leading cutting element and the instrumented cutting element as well as the starting axial offset between them can be used to calculate the engagement area between the instrumented cutting element and the formation.

Figure 10A:
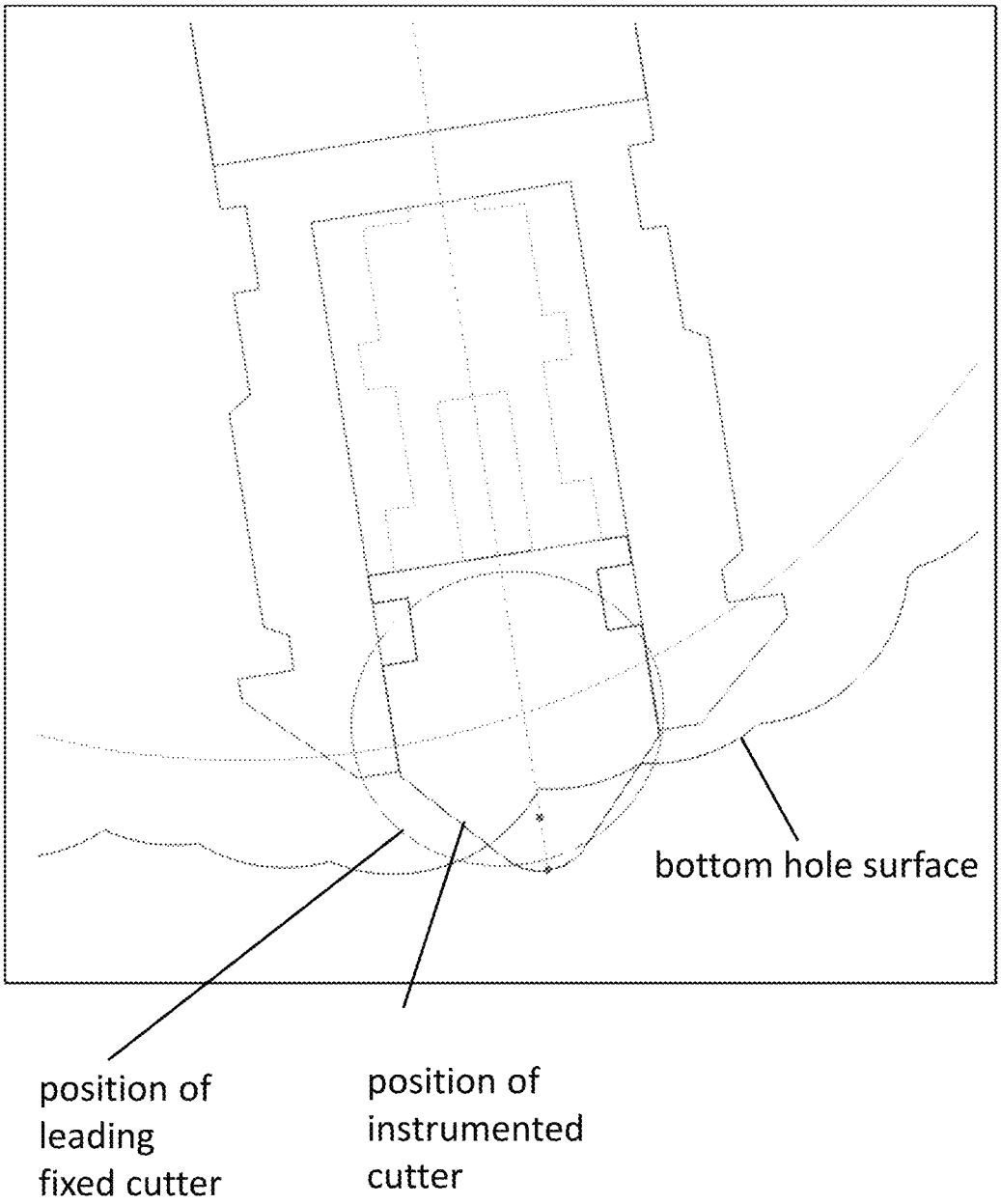
FIG. 10A is a schematic illustration of an example positive Tipp_offset (+0.5 mm)

FIG. 10A shows an example positive Tipp_offset (+0.5 mm). The irregular curve represents the shape of the bottom hole surface. The position of the leading fixed cutter element and the instrumented cutter element are shown. The drilling direction is down and the instrumented cutter element will remove the rock located at the position of the leading fixed cutter element. The part of the leading fixed cutter element that extends outside the position of the leading fixed cutter element represents the depth of cut of the instrumented cutting element (i.e., the cutting element with the first sensor) y'. Data representing the surface area of the instrumented cutter element that is engaged with the rock can be calculated. This rock contact surface area data will be a function of y' and the bit and cutter design (geometry).

Figure 10B:
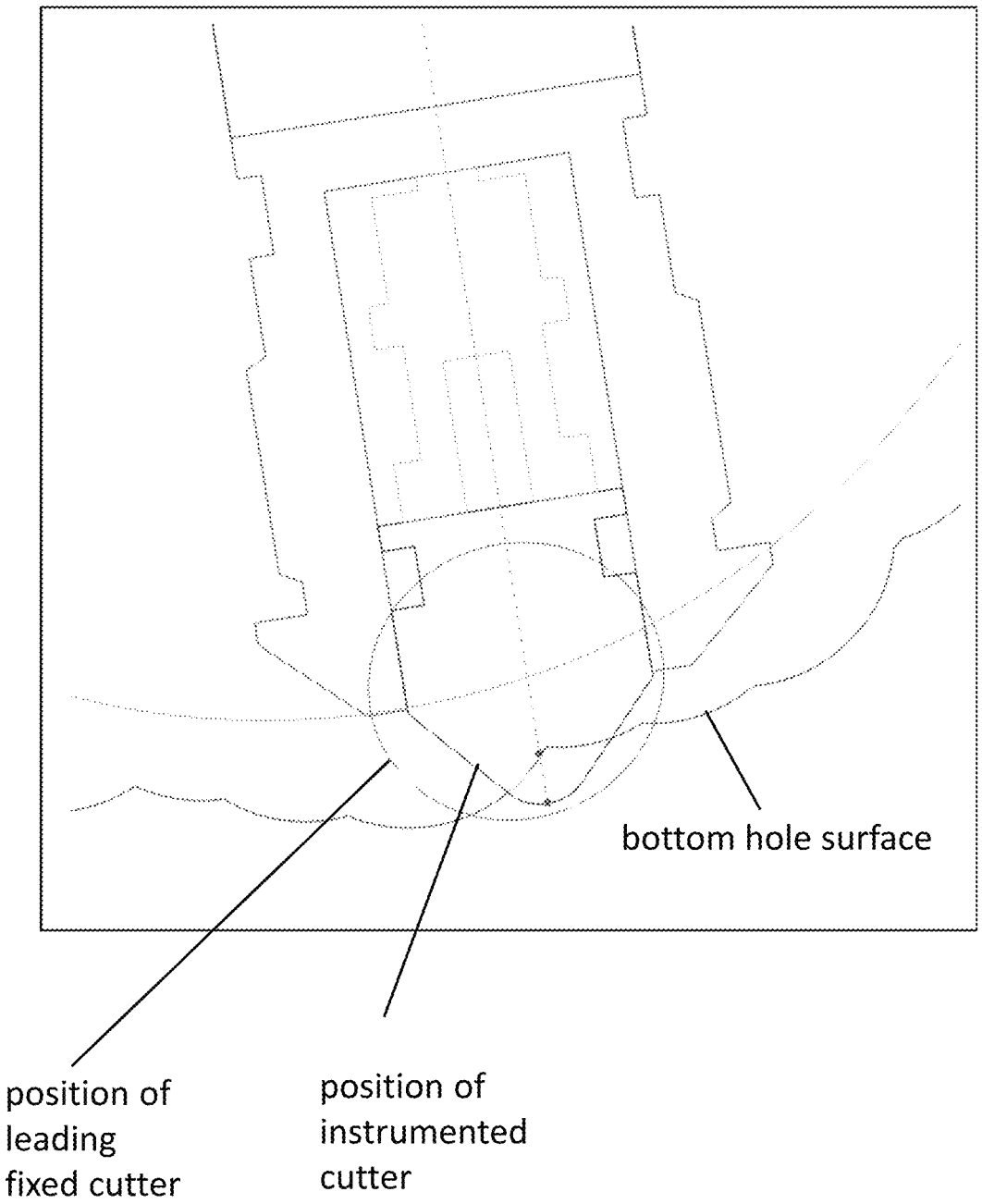
FIG. 10B shows an example negative Tipp_offset (−0.5 mm); the Tipp_offset quantifies the exposure of the tip of the instrumented cutting element (i.e., the cutting element with the first sensor) of the drill bit relative to the tip of the leading fixed cutter element disposed adjacent to the depth sensor of the drill bit.

FIG. 10B shows an example negative Tipp_offset (−0.5 mm). In this configuration, the instrumented cutter element is located inside the position of the leading fixed cutter element and would not engage the rock at all (in this specific scenario).

In block 907, data representing force acting on the instrumented cutting element can be determined from the measurements of instrumented cutting element force sensor, and such data can be stored.

In block 909, the force data of block 907 and the engaged area data of block 905 can be used to generate and store data representing contact stress against the formation, which can be used as an estimate of formation strength. In embodiments, the data representing contact stress against the formation (and the estimate of formation strength) can be calculated by dividing the force data of block 907 by the engaged area data of block 905.

In optional block 911, the data representing estimate of formation strength of block 911 can be output (for example, by display or communication) for use in oilfield operations/planning, such as formation characterization while drilling, or drilling efficiency analysis while drilling. Specifically, the data representing estimate of formation strength of block 911 is similar to UCS and can be used to determine if and when it is necessary to replace part or all of the drill bit used for drilling the formation.

Figure 11:
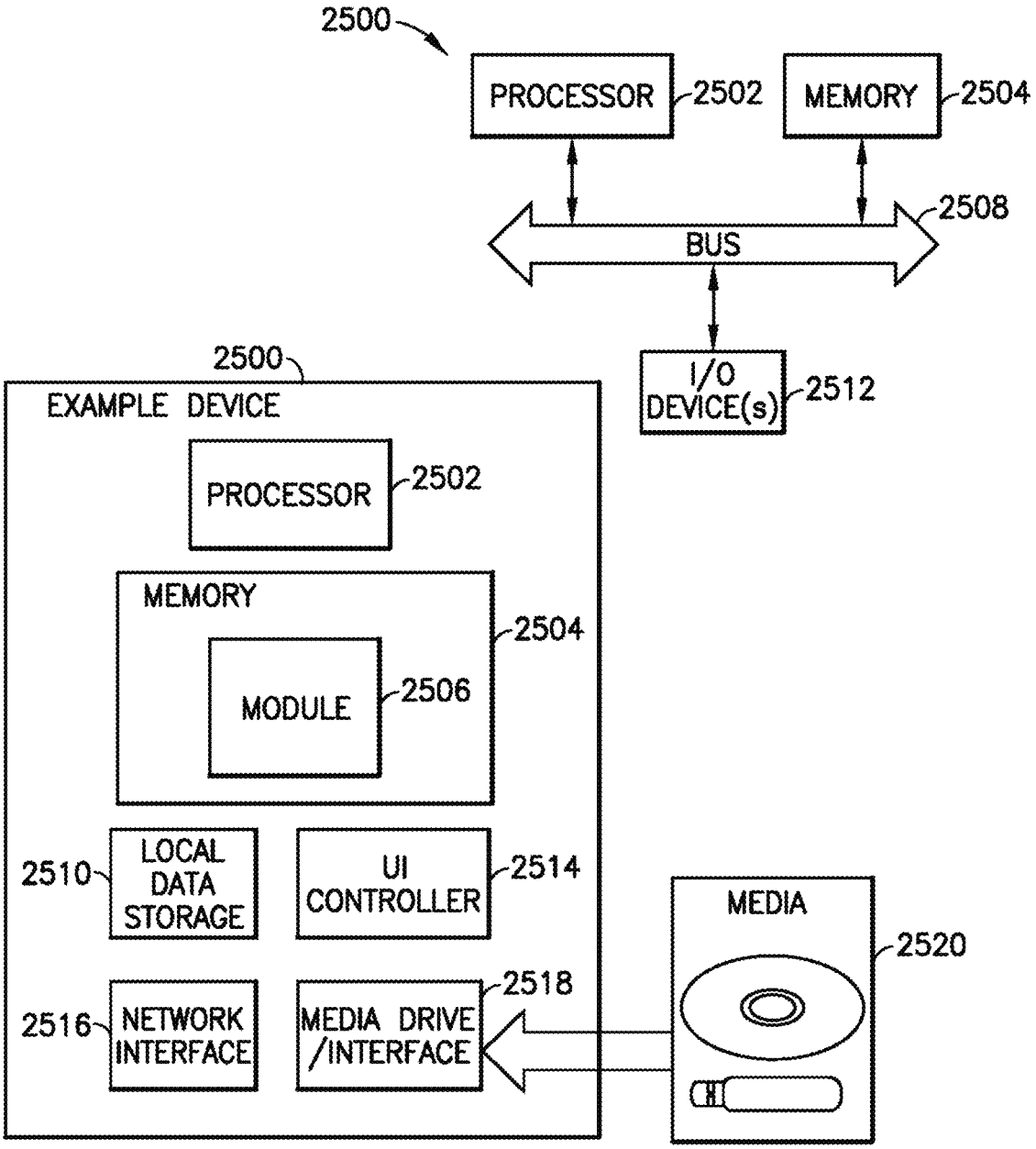
FIG. 11 is a schematic diagram of a computer system.

FIG. 11 illustrates an example device 2500, with a processor 2502 and memory 2504 that can be configured to implement various embodiments of the processes and systems as discussed in the present application. For example, various steps or operations of the processes or systems as described herein can be embodied by computer program instructions (software) that execute on the device 2500. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various processes and systems of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer. Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server over a communication network (e.g., the Internet).

The present disclosure includes a number of practical applications having features described herein that provide benefits and/or solve problems associated with characterizing rock properties of an earth formation while drilling. Some example benefits are discussed herein in connection with various features and functionalities provided by a system implemented on one or more computing devices. It will be appreciated that benefits explicitly discussed in connection with one or more embodiments described herein are provided by way of example and are not intended to be an exhaustive list of all possible benefits of the methods and systems and further are not intended to limit the scope of the claims.

For example, in oilfield operations/planning such as formation characterization while drilling, or drilling efficiency analysis while drilling, it can be critical to characterize rock properties (such as formation strength) of the earth formation to evaluate if and when it will be necessary to replace a drill bit used to drill the borehole into the formation. Such analysis can avoid bit degradation and failure that can lead to inefficiencies and higher costs of the drilling operations. Furthermore, the analysis can avoid the time and costs associated with obtaining rock samples and evaluating the rocks samples in a laboratory.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

Although only a few example embodiments have been described in detail above, those skilled in the art will readily appreciate that many modifications are possible in the example embodiments without materially departing from this invention.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for characterizing a formation while drilling a borehole through the formation, the method comprising:

drilling the borehole with a drill bit that is instrumented with a first sensor and a second sensor;

configuring a processor to i) determine and store first data representing cutting forces acting on a cutting element of the drill bit while drilling based on measurements of the first sensor while drilling;

ii) determine and store second data representing depth of cut of the drill bit while drilling based on measurements of the second sensor while drilling; and iii) process the first data and second data to generate and store data representing contact stress against the formation while drilling; and mapping measurements of the second sensor while drilling to the second data representing depth of cut of the drill bit while drilling;

mapping the second data to data representing depth of the cutting element of the drill bit while drilling;

determining data representing surface area contacted by the cutting element while drilling from the data representing depth of the cutting element of the drill bit while drilling and data representing geometry of the drill bit; and determining the data representing contact stress against the formation while drilling from the first data and the data representing surface area contacted by the cutting element while drilling.

2. A method according to claim 1, wherein:

the data representing contact stress against the formation provides an estimate of formation strength.

3. A method according to claim 1, wherein:

the first sensor is integral to the cutting element of the drill bit.

4. A method according to claim 1, wherein:

the second sensor is integral to the drill bit at a predefined location offset from the first sensor.

5. A method according to claim 1, wherein:

the first sensor is configured to measure forces acting on the cutting element of the drill bit while drilling.

6. A method according to claim 1, wherein:

the second sensor comprises a depth sensor that contacts and rides on a bottom hole surface while drilling and is used to measure a gradient or slope of the bottom hole surface while drilling.

7. A method according to claim 6, wherein:

the oilfield operations/planning include formation characterization while drilling or drilling efficiency analysis while drilling.

8. A method according to claim 1, further comprising:

using the data representing contact stress against the formation in oilfield operations/planning.

9. A method according to claim 1, wherein:

the processor is located at the surface and operated while drilling the borehole, or the processor is located in the borehole and operated while drilling the borehole.

10. A drilling system comprising:

a drill bit for drilling a borehole through the formation, wherein the drill bit is instrumented with a first sensor and a second sensor;

a processor configured to:

i) determine and store first data representing cutting forces acting on a cutting element of the drill bit while drilling based on measurements of the first sensor while drilling;

ii) determine and store second data representing depth of cut of the drill bit while drilling based on measurements of the second sensor while drilling; and iii) process the first data and second data to generate and store data representing contact stress against the formation while drilling; and the processor is further configured to:

map measurements of the second sensor while drilling to the second data representing depth of cut of the drill bit while drilling, map the second data to data representing depth of the cutting element of the drill bit while drilling, determine data representing surface area contacted by the cutting element while drilling from the data representing depth of the cutting element of the drill bit while drilling and data representing geometry of the drill bit, and determine the data representing contact stress against the formation while drilling from the first data and the data representing surface area contacted by the cutting element while drilling.

11. A drilling system according to claim 10, wherein:

the data representing contact stress against the formation provides an estimate of formation strength.

12. A drilling system according to claim 10, wherein:

the first sensor is integral to the cutting element of the drill bit.

13. A drilling system according to claim 10, wherein:

the second sensor is integral to the drill bit at a predefined location offset from the first sensor.

14. A drilling system according to claim 10, wherein:

the first sensor is configured to measure forces acting on the cutting element of the drill bit while drilling.

15. A drilling system according to claim 10, wherein:

the second sensor comprises a depth sensor that contacts and rides on a bottom hole surface while drilling and is used to measure a gradient or slope of the bottom hole surface while drilling.

16. A drilling system according to claim 10, wherein:

the data representing contact stress against the formation is output for use in oilfield operations/planning.

17. A drilling system according to claim 16, wherein:

the oilfield operations/planning include formation characterization while drilling or drilling efficiency analysis while drilling.

18. A drilling system according to claim 10, wherein:

the processor is located at the surface and operated while drilling the borehole, or the processor is located in the borehole and operated while drilling the borehole.

* * * * *